United States Patent [19]

Nieder

[11] Patent Number: 4,637,847

[45] Date of Patent: Jan. 20, 1987

[54] CHEMICAL PASSIVATION OF AMORPHOUS BORON POWDER

[75] Inventor: Erin G. Nieder, Manassas, Va.

[73] Assignee: Atlantic Research Corporation, Alexandria, Va.

[21] Appl. No.: 563,969

[22] Filed: Dec. 21, 1983

[51] Int. Cl.[4] ..... C06B 45/32

[52] U.S. Cl. ..... 149/6; 149/22; 149/19.92; 427/215; 427/220; 427/399

[58] Field of Search ..... 149/6, 22, 19.92; 427/215, 216, 220, 399

[56] References Cited

U.S. PATENT DOCUMENTS

| | | | |
|---|---|---|---|
| 2,680,696 | 6/1954 | Broge | 427/220 |
| 2,829,982 | 4/1958 | Hoyt | 427/221 |
| 2,973,282 | 2/1961 | Gross | 427/220 |
| 3,238,076 | 3/1966 | Taylor et al. | 149/22 |
| 3,730,789 | 5/1973 | Mueller et al. | 149/22 |
| 3,788,906 | 1/1974 | Schroeder | 149/6 |
| 3,920,865 | 11/1975 | Läufer et al. | 427/220 |
| 3,976,521 | 8/1976 | Boyd et al. | 149/22 |
| 3,986,909 | 10/1976 | Macri | 149/22 |
| 4,068,024 | 1/1978 | Laufer | 427/220 |
| 4,090,895 | 5/1978 | Outten | 149/22 |

*Primary Examiner*—Edward A. Miller

*Attorney, Agent, or Firm*—Quaintance, Murphy & Presta

[57] ABSTRACT

Amorphous boron powder is chemically passivated by treatment with certain alcohols so as to form stable borate esters on the surface so as to render the boron unreactive or compatible with hydroxyl-functional prepolymers. The treated or passivated boron is used in the manufacture of hydroxyl-terminated poly-butadiene matrix castable solid fuels and propellants.

26 Claims, No Drawings

CHEMICAL PASSIVATION OF AMORPHOUS BORON POWDER

FIELD OF THE INVENTION

This invention relates to the treatment of amorphous boron powder. More specifically, this invention relates to the treatment of boron powder in the manufacture of solid polymeric matrix fuels and propellants.

BACKGROUND AND DISCUSSION OF THE PRIOR ART

In the manufacture of propellants and fuels, it was generally known to utilize borates or borohydride salts, as disclosed in U.S. Pat. No. 3,563,818 to Miller et al. and U.S. Pat. No. 3,564,561 to Carvalho et al. Certain metaborate esters which were formed from acyclic polyols and metaboric acid were found useful in liquid fuels and lubricants as is disclosed in U.S. Pat. No. 2,866,811 to Irish et al. It was also known to utilize triethanolamines in propellants and fuels as disclosed in U.S. Pat. No. 3,790,416 to Dehm; U.S. Pat. No. 3,807,973 to Iwama et al.; and U.S. Pat. No. 4,154,633 to Pierce.

It was desired in the castable solid propellant and fuel art to incorporate powdered amorphous boron with a binder pre-polymer having hydroxyl-functional groups. This attempted incorporation was only limitedly successful because it was found that there is a reaction between the boron surface impurities, namely, boric acid and boron oxide, and hydroxyl-functionally active pre-polymers, so as to form borates. The multi-functional pre-polymer reaction caused cross-linking with the boron which resulted in a non-flowing, noncastable, rubbery mass.

It is therefore a principal object of the present invention to provide a method for rendering the amorphous boron unreactive to the hydroxyl-functional pre-polymers so as to provide a castable substance for solid propellants and fuels.

SUMMARY OF THE INVENTION

Broadly speaking, the present invention is the treatment of amorphous boron powder with an alcohol to form a stable borate which will not react with the hydroxyl-functional pre-polymers, in the formation of castable solid propellants.

DESCRIPTION OF THE PREFERRED EMBODIMENTS

Amorphous powdered boron is treated with an alcohol to form a stable borate in the presence of a hydroxyl-functional pre-polymer.

It is an important aspect of the present invention that the alcohol form a borate having a half life of at least about 3 days in aqueous solution. This is the requisite passivation level.

Suitable alcohols useful pursuant to the present invention include by way of example: 2,6,8-trimethyl-4-nonyl alcohol; 3-pentanol; 2-cyclohexylcyclohexanol; dicyclohexylcarbinol; 2-phenylcyclohexanol; diisopropyl carbinol; diisolutylcarbinol; 1,3-propane diol; 1,4-butane diol; 1,3-pentane diol; 1,5-pentane diol; 2,4-hexane diol; 1,6-hexane diol; 2-methyl-2,4-pentane diol; diethanol amine: diisopropanol amine; N-methyl diethanol amine trimethylol ethane; trimethylol propane; triethylol butane; trimethanol amine; triethanol amine; triisopropanolamine, and the like. Triisopropanolamine is most preferred.

It is preferred that the alcohol be a polyfunctional alcohol, although certain monofunctional alcohols, such as the aforesaid polyalkyl carbinols, have been found to be useful.

In a more specific aspect, the present invention may be said to be a method encompassing;

(a) rinsing or purging amorphous boron powder with a solvent or gas to minimize boron oxide and/or boric acid prior to treatment with an alcohol;
(b) dissolving an alcohol in an organic solvent;
(c) adding the boron to the alcohol solution so as to disperse the boron powder;
(d) evaporating the solvent but not the alcohol; and
(e) heating the boron and alcohol to react same to form a stable borate.

The rinse or purge compounds should be those in which boron oxide and/or boric acid are soluble or with which boron oxide and/or boric acid react. Suitable compounds include, by way of example, ethanol, ammonia and the like.

The alcohol as previously described, should be present in an amount of 0.5 to 30% by weight based on the weight of boron, and the weight percent should be commensurately proportional to the boron surface impurities of boric acid and boron oxide. That is, the higher the concentration of boric acid and boron oxide, the greater the percentage of alcohol. It is desired that preferably from about 3 to 15% be employed, although the lower amounts are most preferred.

The organic solvent should be one that is generally more volatile than the alcohol. Suitable organic solvents, by way of example include: acetone, pentane and the like. The solvent should be evaporated at low temperatures or allowed to evaporate at room temperature. After solvent evaporation, the alcohol-boron dispersion is heated at temperatures of from about 200 to 275 degrees F. for about 10 to 20 hours, and preferably at about 250° F. for about 17 hours. This extended heating will cause the boron and alcohol to react to form a stable borate surface coating on the amorphous boron powder.

The stable borate coated boron powder may then be readily incorporated in well-known hydroxyl-functional prepolymers for preparing a solid fuel or solid propellant. Suitable pre-polymers useful in the present invention include by way of example, hydroxy-terminated polybutadiene (HTPB); hydroxyl-terminated polyisobutylene; hydroxyl-terminated polyacrylate esters; hydroxyl-terminated fluorocarbons; hydroxy-terminated polyesters; hydroxyl-terminated polyethers; hydroxyl-terminated polysulfides, and the like.

The cross-linkable propellant may then be cured and cast by means well known to one skilled in the art.

EXAMPLE I

Amorphous boron powder is rinsed with ethanol, the ethanol filtered off and the remaining product dried at 250° F. for approximately 17 hours. Three (3%) percent (per weight of boron) of triisopropanolamine (TIA) is dissolved in acetone. The boron is slowly added to the acetone-TIA solution and stirred intermittently for 15 minutes to disperse the boron. The dispersion is poured into a pan and the acetone is allowed to evaporate. The dispersion is heated under vacuum at 250° F. approximately 17 hours to form a stable boron surface coating.

EXAMPLE II

Amorphous boron powder is purged with ammonia gas, and the ammonia vapor removed from the boron surface. Ten point eight one (10,81%) percent by weight (per weight of boron) of di-isobutylcarbinol (DIBC) is dissolved in pentane solvent. The boron is slowly added to the DIBC-pentane solution with intermittent stirring to disperse the boron. The dispersion is poured into a pan to allow the solvent to evaporate at room temperature. The dispersion is heated under vacuum at 250° F. for approximately 17 hours to form a stable boron surface coating.

What I claim is:

1. A method for treating amorphous boron powder comprising:

(a) reacting the boron powder with an alcohol to form a borate coated boron powder; and (b) combining the reacted boron powder with a hydroxyl-functional pre-polymer, whereby there is no reaction between the polymer and the reacted boron powder.

2. The method of claim 1, wherein the alcohol forms a borate having a half-life in water of at least about 3 days.

3. The method of claim 2, wherein the pre-polymer is a polybutadiene.

4. The method of claim 2, further comprising molding the product of step (b) so as to form a solid fuel or solid propellant.

5. The method of claim 2, wherein the alcohol is triisopropanolamine.

6. The method of claim 2, wherein the alcohol is di-isobutylcarbinol.

7. The method of claim 1, wherein the weight of alcohol is from 0.5 to 30% by weight based on the weight of the boron, and the alcohol weight percent being commensurately proportional to the boric acid and boric oxide present on the surface of the boron powder.

8. The method of claim 7, wherein the alcohol weight percentage is about 3 to 15%.

9. The method of claim 2, further comprising dissolving the alcohol in an organic solvent

10. The method of claim 9, wherein the solvent is one selected from the group consisting of acetone and an alkane.

11. The method of claim 9, further comprising evaporating the solvent prior to step (a).

12. The method of claim 11, wherein reacting further comprises heating.

13. The method of claim 12, wherein the heating is at 200°-275° F.

14. The method of claim 13, wherein the heating is for 10-20 hours.

15. The method of claim 14, wherein the heating is under vacuum.

16. The method of claim 11, further comprising rinsing the boron prior to step (a).

17. The method of claim 11, further comprising purging the boron prior to step (a).

18. The method of claim 16, wherein the boron is rinsed with ethanol.

19. The method of claim 17, wherein the boron is purged with ammonia.

20. A method for treating amorphous boron powder comprising:

(a) rinsing amorphous boron powder;

(b) dissolving an alcohol in an organic solvent;

(c) adding the boron to the alcohol solution so as to disperse the boron powder;

(d) evaporating the solvent but not the alcohol; and (e) heating the boron and alcohol to react same to form a stable borate coated boron powder.

21. The method of claim 20, wherein the alcohol forms a borate having a half-life in water of at least 3 days.

22. The method of claim 21, wherein the weight of alcohol is from 0.5 to 30% by weight based on the weight of the boron, and the alcohol weight percent being commensurately proportional to the boric acid and boric oxide present on the surface of the boron powder.

23. The method of claim 22, wherein the heating is at 200°-275° F.

24. The method of claim 23, wherein the heating is for 10-20 hours.

25. The method of claim 24, wherein the heating is under vacuum.

26. A method for treating amorphous boron powder comprising:

(a) purging amorphous boron powder;

(b) dissolving an alcohol in an organic solvent;

(c) adding the boron to the alcohol solution so as to disperse the boron powder;

(d) evaporating the solvent but not the alcohol; and (e) heating the boron and alcohol to react same to form a stable borate coated boron powder.

* * * * *